US005901861A

United States Patent [19]

Huguet

[11] Patent Number: 5,901,861

[45] Date of Patent: May 11, 1999

[54] PLASTIC BAG DRYING RACK

[76] Inventor: Phillip E. Huguet, 1432 Wiesner St., Green Bay, Wis. 54304

[21] Appl. No.: 09/070,651

[22] Filed: Apr. 30, 1998

[51] Int. Cl.[6] ..... A47F 7/00

[52] U.S. Cl. ..... 211/85.15

[58] Field of Search ..... 211/85.15, 174, 211/12; 248/95

[56] References Cited

U.S. PATENT DOCUMENTS

| | | | |
|---|---|---|---|
| 3,295,694 | 1/1967 | Nejezchleb et al. | 211/85.15 |
| 5,188,244 | 2/1993 | Hollstegge | 211/85.15 |
| 5,303,827 | 4/1994 | Ross | 211/85.15 |

*Primary Examiner*—Alvin Chin-Shue
*Assistant Examiner*—Sarah Purol

[57] ABSTRACT

A new plastic bag drying rack for drying plastic bags, especially re-sealable plastic bags, after they have been washed. The inventive device includes a base and a plurality of drying frames. The base has top and bottom faces. The base also has a plurality of spaced apart slots therethrough extending between the top and bottom faces of the base. The slots of the base are arranged in a number of rows on the base, with each row having a pair of slots. Each drying frame has top and bottom edges and a pair of side edges extending between the top and bottom edges of the drying frame. The bottom edge of each of the drying frames has a pair of spaced apart tabs extending therefrom. The tabs of each of the drying frames is inserted into the pair slots of an associated row such that each drying frame is upwardly extended from the top face of the base.

19 Claims, 2 Drawing Sheets

10
11
22
21
23
15
18
17
13
12
19
16

24
22
11
23
22
10

13
18
17
16
19

PLASTIC BAG DRYING RACK

BACKGROUND OF THE INVENTION

1. Field of the Invention

The present invention relates to drying racks and more particularly pertains to a new plastic bag drying rack for drying plastic bags, especially re-sealable plastic bags, after they have been washed.

2. Description of the Prior Art

The use of drying racks is known in the prior art. More specifically, drying racks heretofore devised and utilized are known to consist basically of familiar, expected and obvious structural configurations, notwithstanding the myriad of designs encompassed by the crowded prior art which have been developed for the fulfillment of countless objectives and requirements.

Known prior art drying racks include U.S. Pat. No. 3,295,694; U.S. Pat. No. 5,188,244; U.S. Pat. No. 5,080,237; U.S. Pat. No. 5,641,137; U.S. Pat. No. 3,826,455; and U.S. Pat. No. Des. 369,528.

While these devices fulfill their respective, particular objectives and requirements, the aforementioned patents do not disclose a new plastic bag drying rack. The inventive device includes a base and a plurality of drying frames. The base has top and bottom faces. The base also has a plurality of spaced apart slots therethrough extending between the top and bottom faces of the base. The slots of the base are arranged in a number of rows on the base, with each row having a pair of slots. Each drying frame has top and bottom edges and a pair of side edges extending between the top and bottom edges of the drying frame. The bottom edge of each of the drying frames has a pair of spaced apart tabs extending therefrom. The tabs of each of the drying frames is inserted into the pair slots of an associated row such that each drying frame is upwardly extended from the top face of the base.

In these respects, the plastic bag drying rack according to the present invention substantially departs from the conventional concepts and designs of the prior art, and in so doing provides an apparatus primarily developed for the purpose of drying plastic bags, especially re-sealable plastic bags, after they have been washed.

SUMMARY OF THE INVENTION

In view of the foregoing disadvantages inherent in the known types of drying racks now present in the prior art, the present invention provides a new plastic bag drying rack construction wherein the same can be utilized for drying plastic bags, especially re-sealable plastic bags, after they have been washed.

The general purpose of the present invention, which will be described subsequently in greater detail, is to provide a new plastic bag drying rack apparatus and method which has many of the advantages of the drying racks mentioned heretofore and many novel features that result in a new plastic bag drying rack which is not anticipated, rendered obvious, suggested, or even implied by any of the prior art drying racks, either alone or in any combination thereof.

To attain this, the present invention generally comprises a base and a plurality of drying frames. The base has top and bottom faces. The base also has a plurality of spaced apart slots therethrough extending between the top and bottom faces of the base. The slots of the base are arranged in a number of rows on the base, with each row having a pair of slots. Each drying frame has top and bottom edges and a pair of side edges extending between the top and bottom edges of the drying frame. The bottom edge of each of the drying frames has a pair of spaced apart tabs extending therefrom. The tabs of each of the drying frames is inserted into the pair slots of an associated row such that each drying frame is upwardly extended from the top face of the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plastic bag drying rack apparatus and method which has many of the advantages of the drying racks mentioned heretofore and many novel features that result in a new plastic bag drying rack which is not anticipated, rendered obvious, suggested, or even implied by any of the prior art drying racks, either alone or in any combination thereof.

It is another object of the present invention to provide a new plastic bag drying rack which may be easily and efficiently manufactured and marketed.

It is a further object of the present invention to provide a new plastic bag drying rack which is of a durable and reliable construction.

An even further object of the present invention is to provide a new plastic bag drying rack which is susceptible of a low cost of manufacture with regard to both materials and labor, and which accordingly is then susceptible of low prices of sale to the consuming public, thereby making such plastic bag drying rack economically available to the buying public.

Still yet another object of the present invention is to provide a new plastic bag drying rack which provides in the apparatuses and methods of the prior art some of the advantages thereof, while simultaneously overcoming some of the disadvantages normally associated therewith.

Still another object of the present invention is to provide a new plastic bag drying rack for drying plastic bags, especially resealable plastic bags, after they have been washed.

Yet another object of the present invention is to provide a new plastic bag drying rack which includes a base and a plurality of drying frames. The base has top and bottom faces. The base also has a plurality of spaced apart slots therethrough extending between the top and bottom faces of the base. The slots of the base are arranged in a number of rows on the base, with each row having a pair of slots. Each drying frame has top and bottom edges and a pair of side edges extending between the top and bottom edges of the drying frame. The bottom edge of each of the drying frames has a pair of spaced apart tabs extending therefrom. The tabs of each of the drying frames is inserted into the pair slots of an associated row such that each drying frame is upwardly extended from the top face of the base.

Still yet another object of the present invention is to provide a new plastic bag drying rack that allows a user an easy way to dry plastic bags after they have been cleaned so that the bags may be re-used rather than thrown away.

Even still another object of the present invention is to provide a new plastic bag drying rack that is collapsible for convenient storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
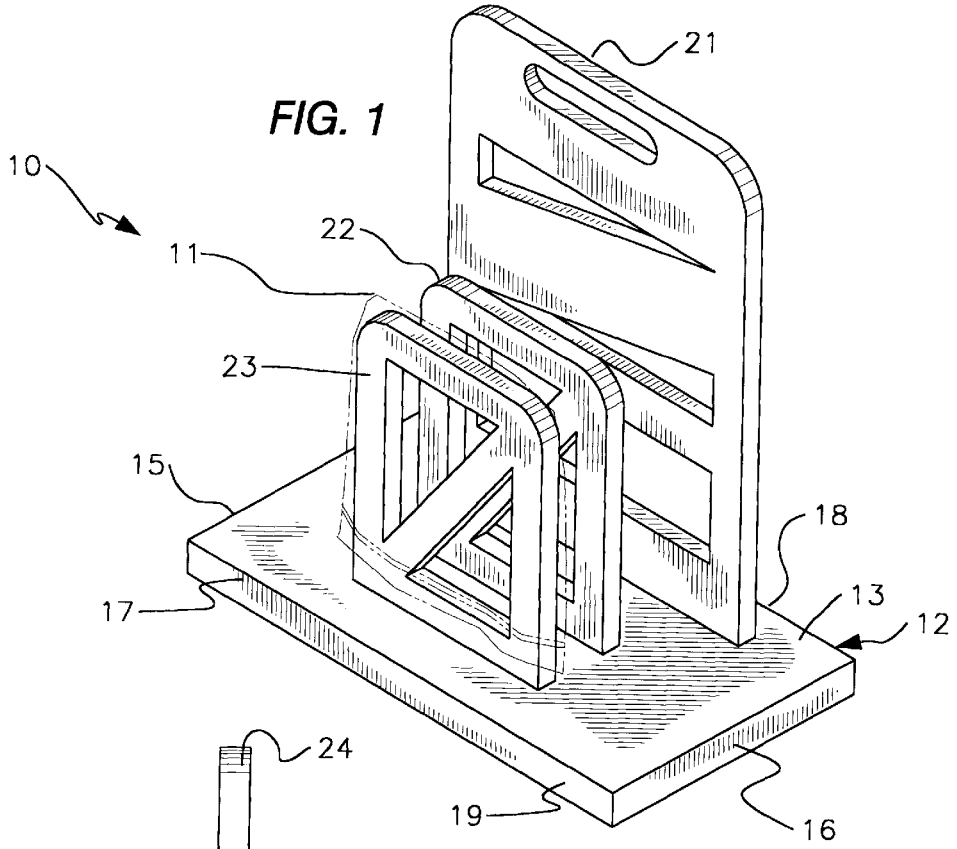
FIG. 1 is a schematic perspective view of a new plastic bag drying rack according to the present invention.

With reference now to the drawings, and in particular to FIGS. 1 through 4 thereof, a new plastic bag drying rack embodying the principles and concepts of the present invention and generally designated by the reference numeral 10 will be described.

As best illustrated in FIGS. 1 through 4, the plastic bag drying rack 10 generally comprises a base 12 and a plurality of drying frames 21,22,23. The base 12 has top and bottom faces 13,14. The base 12 also has a plurality of spaced apart slots 20 therethrough extending between the top and bottom faces 13,14 of the base 12. The slots 20 of the base 12 are arranged in a number of rows on the base 12, with each row having a pair of slots 20. Each drying frame has top and bottom edges 24,25 and a pair of side edges extending between the top and bottom edges 24,25 of the drying frame. The bottom edge 25 of each of the drying frames 21,22,23 has a pair of spaced apart tabs 26,27 extending therefrom. The tabs 26,27 of each of the drying frames 21,22,23 is inserted into the pair slots 20 of an associated row such that each drying frame is upwardly extended from the top face 13 of the base 12.

In use, the drying rack 10 is designed for hanging flexible plastic bags 11 thereon for drying the plastic bags 11 after washing. Preferably, the plastic bags are hung upside down on the drying frames of the drying rack so that the insides of the bags can dry.

In closer detail, the a base 12 of the drying rack 10 is preferably generally rectangular. The base 12 has top and bottom faces 13,14, a pair of ends 15,16 and a pair of sides 17,18 extending between the ends 15,16 of the base 12. The length of the base 12 is defined between the ends 15,16 of the base 12 and the width of the base 12 is defined between the sides 17,18 of the base 12. Preferably, the dimension of the width of the base 12 is less than about three-fifths the dimension of the length of the base 12. In a preferred embodiment, the bottom face 14 has a perimeter lip 19 downwardly extended from it around the periphery of the base 12. The perimeter lip 19 is designed for resting on a surface for providing a space between the bottom face 14 and the resting surface.

The base 12 also has a plurality of spaced apart slots 20 through it extending between the top and bottom faces 13,14 of the base 12. The slots 20 of the base 12 are preferably arranged in a pair of columns and a number of rows on the base 12 such that with each row having a pair of slots 20 and each column has a number of slots 20. The columns of slots 20 are extended between the sides 17,18 of the base 12 preferably substantially parallel to the ends 15,16 of the base 12. The rows of slots 20 are extended between the ends 15,16 of the base 12 preferably substantially parallel to the sides 17,18 of the base 12. Ideally, the number of rows of slots 20 comprises three rows such that each column of slots 20 has three slots 20.

Figure 2:
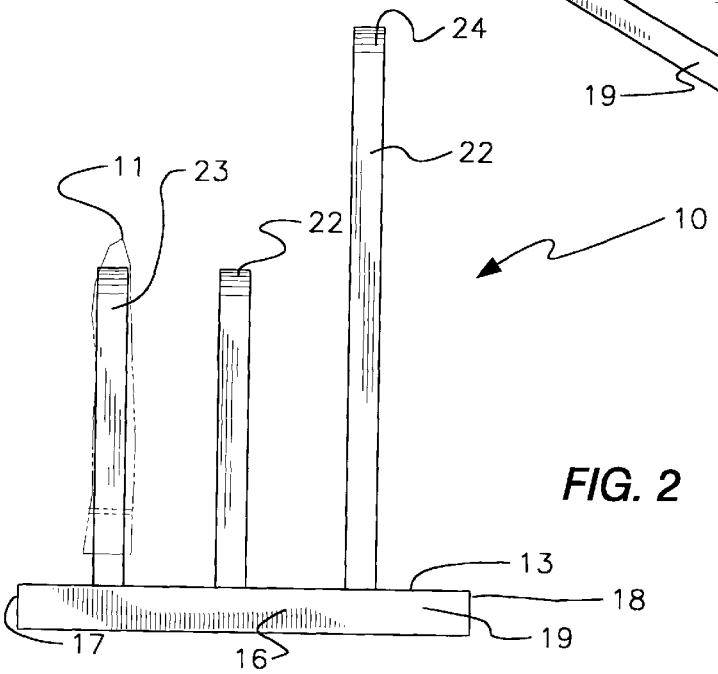
FIG. 2 is a schematic end side view of the present invention in use with a plastic bag being hung on one of the drying frames.
Figure 3:
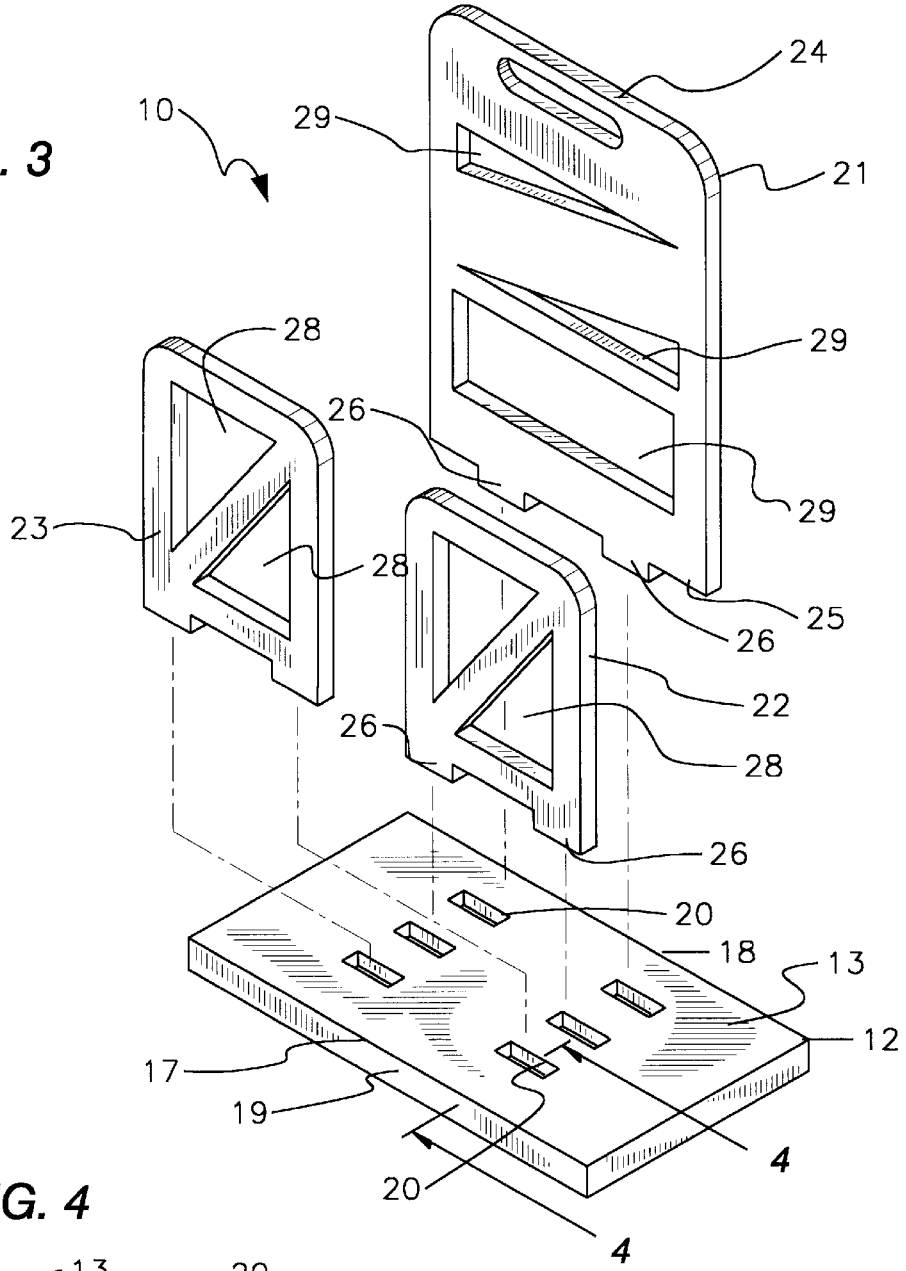
FIG. 3 is a schematic exploded perspective view of the present invention.
Figure 4:
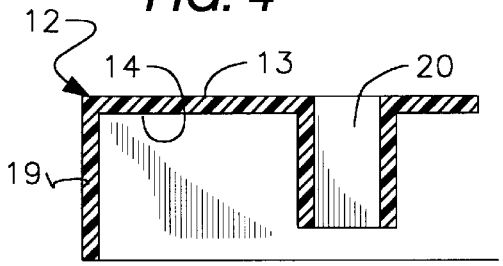
FIG. 4 is a schematic sectional view of a portion of the base of the present invention taken from line 4—4 on FIG. 3.

The drying rack has a plurality of drying frames 21,22,23. With reference to FIG. 2, the drying frames 21,22,23 are designed for inserting into the opening of an inverted plastic bag 11 to let the plastic bag 11 (and especially the inside of the plastic bag 11) dry. Each drying frame 21,22,23 is preferably generally rectangular and has top and bottom edges 24,25 and a pair of side edges extending between the top and bottom edges 24,25 of the drying frame. In an ideal illustrative embodiment, the plurality of drying frames 21,22,23 preferably comprises three drying frames 21,22,23. The bottom edge 25 of each of the drying frames 21,22,23 has a pair of spaced apart tabs 26,27 downwardly extending therefrom. The tabs 26,27 of each of the drying frames 21,22,23 are removably inserted into the pair slots 20 of an associated row such that each drying frame is upwardly extended from the top face 13 of the base 12 substantially perpendicular to the plane the top face 13 of the base 12 lies in. Preferably, each of the drying frames 21,22,23 has a plurality of drying holes 28,29 therethrough for permitting air to pass through them to aid the drying of a plastic bag 11 placed over the drying frame.

The length of each of the drying frames 21,22,23 is defined between the top and bottom edges 24,25 of the drying frame while the width of each of the drying frames

21,22,23 is defined between the side edges of the drying frame. Preferably, the length of each of the drying frame is greater than about 6 inches. Ideally, the length of at least one of the drying frames 21 is greater than about 11 inches. Preferably, the width of each of the drying frames 21,22,23 is greater than about 5 inches. Ideally, the width of at least one of the drying frames 21 is greater than about 9 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drying rack for flexible plastic bags, said drying rack comprising:

a base having top and bottom faces;

said base having a plurality of spaced apart slots therethrough extending between said top and bottom faces of said base;

said slots of said base being arranged in a number of rows on said base, each row having a pair of slots;

a plurality of drying frames, each drying frames having top and bottom edges and a pair of side edges extending between said top and bottom edges of said drying frame;

said bottom edge of each of said drying frames having a pair of spaced apart tabs extending therefrom, said tabs of each of said drying frame being inserted into the pair slots of an associated row such that each drying frame is upwardly extended from said top face of said base; and said bottom face of said base having a perimeter lip downwardly extending therefrom around the periphery of said base, said perimeter lip being adapted for resting on a resting surface such that said bottom face of said base is spaced above the resting surfaces wherein each of said drying frames has a plurality of drying holes therethrough.

2. The drying rack of claim 1, wherein said base is generally rectangular and has a pair of ends and a pair of sides extending between said ends of said base, said base having a length defined between said ends of said base and said base having a width defined between said sides of said base.

3. The drying rack of claim 2, wherein the dimension of said width of said base is less than about three-fifths the dimension of said length of said base.

4. The drying rack of claim 2, wherein said slots of said base are arranged in a pair of columns such that with each row having a pair of slots and each column has a number of slots.

5. The drying rack of claim 4, wherein said columns of slots being extended between said sides of said base, said rows of slots being extended between said ends of said base.

6. The drying rack of claim 4, wherein said number of rows of slots comprises three rows such that each column of slots has three slots.

7. The drying rack of claim 1, wherein each of said drying frames has a length defined between said top and bottom edges of the drying frame, and each of said drying frames has a width defined between said side edges of the drying frame, wherein said length of each of said drying frame is greater than about 6 inches, and wherein said width of each of said drying frames is greater than about 5 inches.

8. The drying rack of claim 7, wherein said length of at least one of said drying frames is greater than about 11 inches, and wherein said width of at least one of said drying frames is greater than about 9 inches.

9. A drying rack for flexible plastic bags, said drying rack comprising:

a base being generally rectangular and having top and bottom faces, a pair of ends and a pair of sides extending between said ends of said base;

said base having a length defined between said ends of said base;

said base having a width defined between said sides of said base;

wherein the dimension of said width of said base is less than about three-fifths the dimension of said length of said base;

said base having a plurality of spaced apart slots therethrough extending between said top and bottom faces of said base;

said slots of said base being arranged in a pair of columns and a number of rows on said base such that with each row having a pair of slots and each column has a number of slots, said columns of slots being extended between said sides of said base substantially parallel to said ends of said base, said rows of slots being extended between said ends of said base substantially parallel to said sides of said base;

wherein said number of rows of slots comprises three rows such that each column of slots has three slots;

said bottom face having a perimeter lip downwardly extended therefrom around the periphery of said base, said perimeter lip being for resting on resting a surface for providing a space between said bottom face and the surface;

a plurality of drying frames, each drying frames being generally rectangular and having top and bottom edges and a pair of side edges extending between said top and bottom edges of said drying frame;

wherein said plurality of drying frames comprises three drying frames;

said bottom edge of each of said drying frames having a pair of spaced apart tabs extending therefrom, said tabs of each of said drying frame being removably inserted into the pair slots of an associated row such that each drying frame is upwardly extended from said top face of said base substantially perpendicular to a plane in which said top face of said base lies;

each of said drying frames having a plurality of drying holes therethrough for permitting air to pass therethrough to aid the drying of a plastic bag placed over a drying frame;

at least one of said drying frames having a top portion a bottom portion, and a pair of side portions defining a generally rectangular central hole through said one drying frame;

said top portion being extended along said top edge of said one drying frame, said bottom portion being extending along said bottom edge of said one drying frame, one of said side portions being extending along one of said side edges of said one drying frame, another of said side portions being extending along another of said side edges of said one drying frame;

said one drying frame having a cross portion extending diagonally across said center hole of said one drying frame, said cross portion being for providing additional structural strength to said one drying frame, said cross portion of said one driving frame dividing said center hole of said one drying frame into a pair of generally triangular dying holes; and each of said drying frames having a length defined between said top and bottom edges of the drying frame, each of said drying frames having a width defined between said side edges of the drying frame.

10. The drying rack of claim 1, wherein at least one of said drying frames has a top portion, a bottom portion, and a pair of side portions defining a generally rectangular central hole through said one drying frame, said top portion being extended along said top edge of said one drying frame, said bottom portion being extending along said bottom edge of said one drying frame, one of said side portions being extending along one of said side edges of said one drying frame, another of said side portions being extending along another of said side edges of said one drying frame, said one drying frame having a cross portion extending diagonally across said center hole of said one drying frame, said cross portion being for providing additional structural strength to said one drying frame, said cross portion of said one drying frame dividing said center hole of said one drying frame into a pair of generally triangular dying holes.

11. The drying rack of claim 1, wherein each of said slots of said base has a perimeter wall therearound downwardly extending from said bottom face of said base, each of said perimeter walls having a generally rectangular configuration.

12. The drying rack of claim 11, wherein each of said perimeter walls has a height defined downwards from said bottom face of said base, wherein said perimeter lip has a height defined downwards from said bottom face of said base, wherein said height of said perimeter lip is greater than said height of each of perimeter walls to permit water to pass below each said slot.

13. The drying rack of claim 12, wherein said height of each of said perimeter walls is greater than said one-half said height of said perimeter lip.

14. A drying rack for flexible plastic bags, said drying rack comprising:

a base having top and bottom faces;

said base having a plurality of spaced apart slots therethrough extending between said top and bottom faces of said base;

said slots of said base being arranged in a number of rows on said base, each row having a pair of slots;

a plurality of drying frames, each drying frames having top and bottom edges and a pair of side edges extending between said top and bottom edges of said drying frame;

said bottom edge of each of said drying frames having a pair of spaced apart tabs extending therefrom, said tabs of each of said drying frame being inserted into the pair slots of an associated row such that each drying frame is upwardly extended from said top face of said base; and said bottom face of said base having a perimeter lip downwardly extending therefrom around the periphery of said base, said perimeter lip being adapted for resting on a resting surface such that said bottom face of said base is spaced above the resting surface;

wherein at least one of said drying frames has a top portion, a bottom portion, and a pair of side portions defining a generally rectangular central hole through said one drying frame, said top portion being extended along said top edge of said one drying frame, said bottom portion being extending along said bottom edge of said one drying frame, one of said side portions being extending along one of said side edges of said one drying frame, another of said side portions being extending along another of said side edges of said one drying frame, said one drying frame having a cross portion extending diagonally across said center hole of said one drying frame, said cross portion being for providing additional structural strength to said one drying frame, said cross portion of said one drying frame dividing said center hole of said one drying frame into a pair of generally triangular dying holes.

15. The drying rack of claim 14, wherein said base is generally rectangular and has a pair of ends and a pair of sides extending between said ends of said base, said base having a length defined between said ends of said base and said base having a width defined between said sides of said base.

16. The drying rack of claim 15, wherein the dimension of said width of said base is less than about three-fifths the dimension of said length of said base.

17. The drying rack of claim 14, wherein each of said slots of said base has a perimeter wall therearound downwardly extending from said bottom face of said base, each of said perimeter walls having a generally rectangular configuration.

18. The drying rack of claim 17, wherein each of said perimeter walls has a height defined downwards from said bottom face of said base, wherein said perimeter lip has a height defined downwards from said bottom face of said base, wherein said height of said perimeter lip is greater than said height of each of perimeter walls to permit water to pass below each said slot.

19. The drying rack of claim 18, wherein said height of each of said perimeter walls is greater than said one-half said height of said perimeter lip.

* * * * *